United States Patent [19]

Jones et al.

[11] Patent Number: 4,768,456

[45] Date of Patent: Sep. 6, 1988

[54] MODULAR FLOAT

[75] Inventors: Gordon S. Jones; J. Ian Hamilton, both of Toronto, Canada

[73] Assignee: Yok International Systems Inc., Toronto, Canada

[21] Appl. No.: 928,122

[22] Filed: Nov. 7, 1986

[51] Int. Cl.[4] ..... B63B 35/00

[52] U.S. Cl. ..... 114/266; 114/267; 405/219

[58] Field of Search ..... 114/352, 77 R, 266, 114/267; 405/219

[56] References Cited

U.S. PATENT DOCUMENTS

| | | | |
|---|---|---|---|
| 2,741,782 | 4/1956 | Muller | 114/352 |
| 3,010,231 | 11/1961 | Matelich | 114/266 X |
| 3,191,565 | 6/1965 | Filak | 114/0.5 |
| 3,289,621 | 12/1966 | Sebring | 114/0.8 |
| 3,752,102 | 8/1973 | Shuman | 114/267 |
| 3,760,754 | 9/1973 | Drummond | 114/0.5 F |
| 3,777,689 | 12/1973 | Olsen et al. | 114/267 |
| 3,844,236 | 10/1974 | Boyajian | 114/0.5 |
| 3,857,248 | 12/1974 | Rutter | 61/65 |
| 4,365,577 | 12/1982 | Heinrich | 405/219 X |
| 4,418,634 | 12/1983 | Gerbus | 114/263 |

FOREIGN PATENT DOCUMENTS

| | | | |
|---|---|---|---|
| 2234182 | 1/1975 | France | 114/266 |

OTHER PUBLICATIONS

Rotocast Flotation Products, Dura Float, bundle of advertisements-mostly undated although the price list is effective Jan. 1, 1982.

Zarn, Inc., Poly-Float, undated.

Rick-a-Tee Raft Incorporated, Rick-a-Tee Raft, undated.

Jetfloat Limited, Ultimate Docking System, undated.

Novadok, Novadok Modules, undated.

Altra Marine Products Inc., Springbok 86, undated.

*Primary Examiner*—Sherman D. Basinger

*Attorney, Agent, or Firm*—Rogers, Bereskin & Parr

[57] ABSTRACT

This invention relates to a modular float, which is in the form of an integral, closed shell, hollow float that is light weight portable and easy to use. It is intended to support marine devices such as docks, rafts and the like. The modular float has two side walls, two end walls extending between the side walls, and a generally rounded lower portion and generally rectangular upper portion, both when viewed from one side. The upper portion has a number of intersecting grooves, which are designed to carry standard sized support members, which in turn carry a deck. The grooves have resilient ridges for releasably engaging the support members.

14 Claims, 4 Drawing Sheets

MODULAR FLOAT

FIELD OF INVENTION

This invention relates to floating marine devices such as docks, rafts, pontoon boats and the like, and in particular, to a modular float, used to provide the required positive buoyancy to such marine devices. This invention more particularly relates to an integral closed shell, hollow, modular float which is light-weight, portable, easily manoeuvered and simple to use.

BACKGROUND OF THE INVENTION

Modular floats are known and have been used in the past to provide buoyancy to many different types of marine devices, such as docks, diving platforms and the like. Modular floats are particularly well suited to support marine devices comprising platforms, as the number of floats can be varied according to the size of the platform to be supported.

Generally, floating marine platforms consist of an upper decking material, which is supported by a series of transverse and longitudinal support members. Various shapes and designs of buoyant materials have been proposed in the past, but for the most part, such designs have been difficult to use and not easily transported, either to the launching site, or in and out of the water once at the launching site.

Essentially, there are two types of modular floats available, those that are integral, and have closed shells, and those that are not integral, and which rely upon a closed cell foam, which fills the float, to provide the required positive buoyancy. This invention relates to an integral shell float, which is hollow and not filled with a closed cell foam.

A particular problem of the previously proposed modular floats, arises from the methods by which such modular floats attach to the marine structure they are intended to support. Some of the prior devices disclose the use of long through bolts which penetrate the float and violate the integrity of the flotation modules. This method of attachment has two disadvantages. Firstly, a closed cell foam must be inserted into the float, to provide buoyancy, and secondly, the marine device must be assembled upside-down, either on land, or in the water in order to attach the nuts to the bolts. Then later, the assembled structure must be flipped over, which can require a considerable amount of strength, and which is unsuitable for an isolated cottager for example.

A second kind of attachment system involves molding bolt holes into the float module, through which screws, or other fasteners can be inserted. However, the necessity of molding such bolt holes adds to the manufacturing costs. Further, it requires the use of special high density cross-linked polyethylene around such bolt holes, so as to provide a sufficient amount of strength around the hole. Finally, assembly is made awkward because it is necessary to crawl underneath the marine structure, if on land, or swim, if it is in the water, to complete the assembly. Also,the plastic tends to lose strength over time, resulting in failure of such floats at the bolt holes.

BRIEF SUMMARY OF THE INVENTION

The present invention provides a modular float for use in supporting marine devices having transverse and longitudinal support members, the modular float comprising:

an integral hollow closed shell having
- two side walls
- two end walls
- a generally rounded lower portion when viewed from an end,and
  - a generally rectangular upper portion when viewed from an end, said upper portion having a plurality of transverse grooves extending between said side walls, and a plurality of longitudinal grooves extending between said end walls, said transverse grooves and said longitudinal grooves intersecting,
- said transverse and longitudinal grooves releasably engaging said support members of said marine devices.

BRIEF DESCRIPTION OF SEVERAL VIEWS OF THE DRAWING

In the drawings, which illustrate a preferred embodiment of the invention.

DETAILED DESCRIPTION

Figure 1:
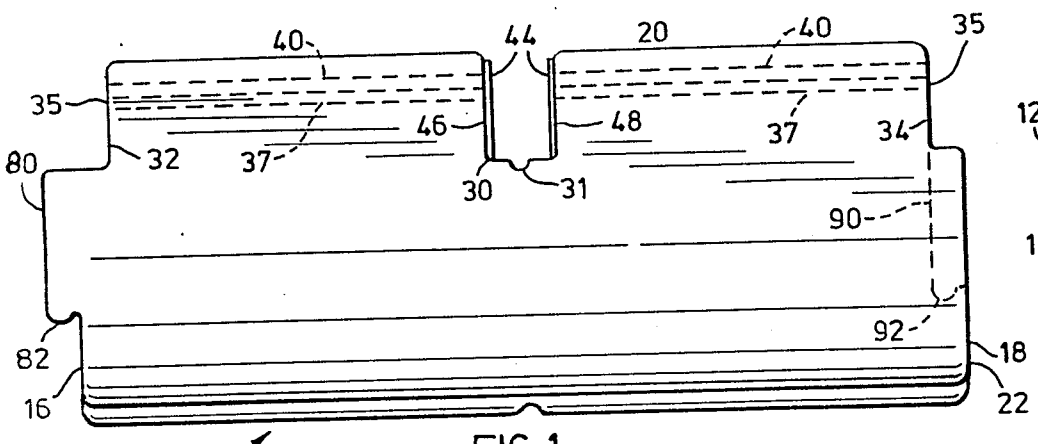
FIG. 1 is a side view of the invention.

In FIG. 1, a modular float according to the present invention is shown generally at 10. The float 10 has two side walls 12 and 18, shown in FIG. 1, an upper portion 20, and a lower portion 22. As can be seen from FIG. 3, the upper portion 20 is of generally rectangular shape when viewed from an end and the lower portion 22 is of generally rounded shape when viewed from an end.

The float 10 is of hollow closed shell construction, and is preferably made of an easily mouldalbe material, such as any common long linked plastic like polyethylene. The float 10 may be formed by conventional molding techniques, such as by rotational or blow-molding.

The upper portion 20 has a number of unique features, including a central transverse groove 30, two transverse end grooves 32 and 34, two longitudinal grooves 36 and 38, and central longitudinal groove 40. The grooves 30, 32, 34, 36 and 38 extend down from a planar top surface 21.

The central transverse groove 30 is rectangular in shape, and extends fully from one side wall to the other. The central transverse groove 30 has a drainage sub channel 31, which also extends fully from one side wall to the other. Under the rocking influence of waves, or of person walking on the marine device, water will be able to drain freely out of the groove 30 by means of the drainage subchannel 31.

In addition to the subchannel 31 the central transverse groove 30 has other drainage features. Specifically, a plurality of ridges 44 are formed into the groove 30, which extend outwardly from the side faces 46 and 48. When a structural member such as 60 is inserted into the groove 30, the ridges 44 perform two functions.

Firstly, the ridges 44 space the member 60 away from the side faces 46 and 48 of the groove 30, allowing water to drain into the subchannel 31 (thereby out of groove 30) and allowing air to circulate around the member 60. Where the member 60 is wood, such drainage will prevent rotting and decay of the wood. Secondly, the ridges 44 act as resilient deformable gripping members which provide for a friction fit for the member 60 in the groove 30. The ridges 44 can be deformed somewhat,so that the transverse member 60 is secured in place, and will not slip out. This has the advantage of eliminating the need for bolts, screws, or other fastening members that were required in the prior art devices, to attach the floats to the floating devices being supported by such floats.

Figure 4:
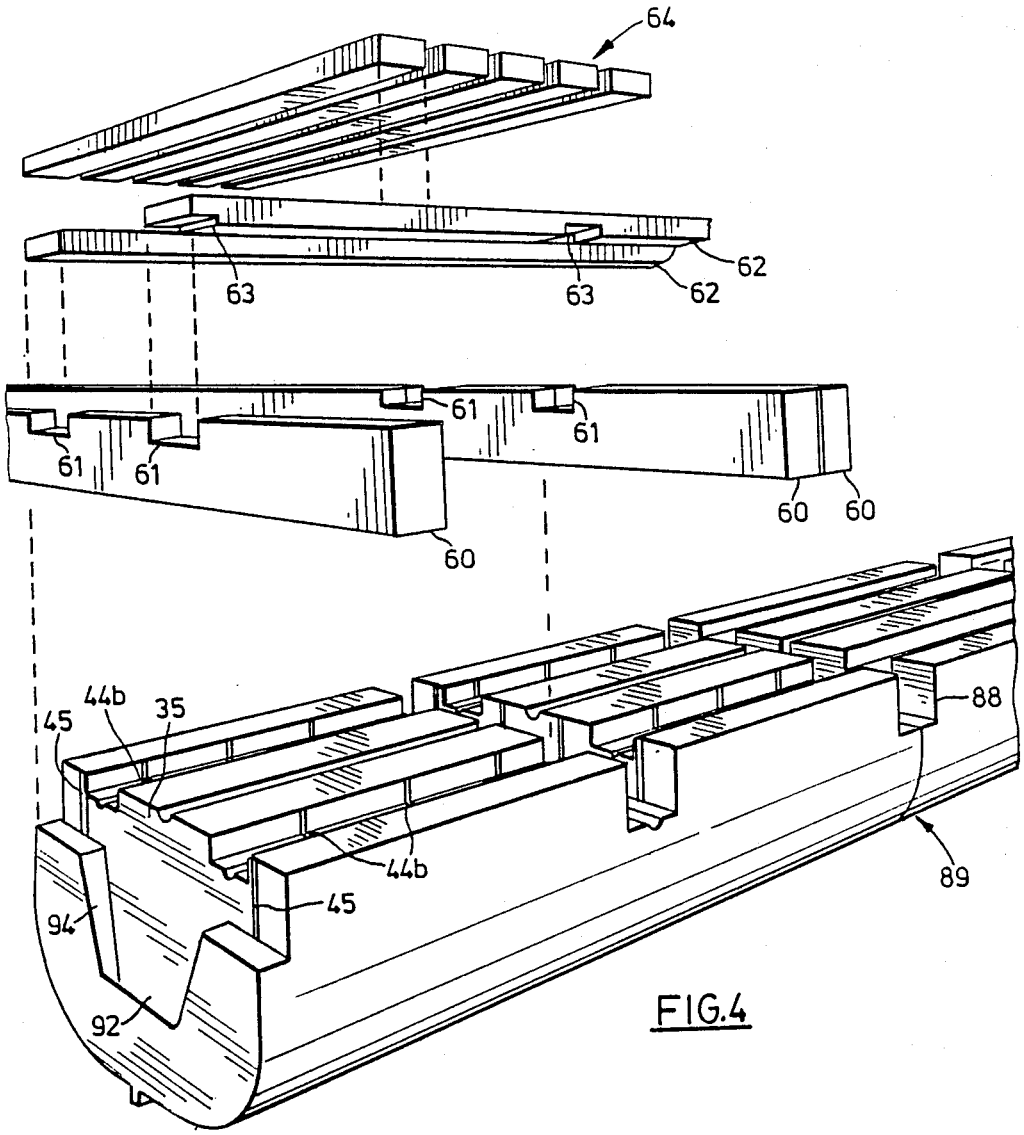
FIG. 4 is an isometric view of the invention from in front and above, with a dock surface shown in exploded perspective above.

As can be seen from FIG. 1, in the preferred embodiment, the end transverse grooves 32 and 34 are approximately one-half the width of the central transverse groove 30. Each groove, 32, 34 is formed as a step having one side wall 35. Vertical ridges 45, correspond to the ridges 44. As shown in FIG. 4 a full transverse groove 88 is formed between adjacent, coupled floats 10 by two of the grooves 32, 34. In this manner, when the modular floats 10 are secured end to end, as described herein, a series of transverse grooves identical in size to groove 30 will be created of the joint 89 between adjacent floats 10, to facilitate easy use of a number of modular floats 10 in supporting a marine device.

The longitudinal grooves 36 and 38 are similar in form to the transverse groove 30 in many ways. For example, the grooves 36, 38 also have a plurality of ridges 44 which allow for drainage and air circulation, as well as deformably allowing a friction fit of a longitudinal support member 62 (shown in FIG. 4). In addition, the longitudinal grooves 36 and 38 have central drainage channels 37 and 39 respectively for draining water away from the support members 62.

The grooves 30, 32 and 34 are intended to carry the primary support members 60, which have their long side (as viewed in section) vertical. This provides the greatest strength when the support members 60 extend between adjacent and spaced modular floats 10. The secondary support members 62 are arranged with their long side horizontal, and in general have smaller dimensions, since they are spanning smaller distances between adjacent support members 60. Correspondingly, the transverse grooves 32, 34, 36, have a greater depth or height than the longitudinal grooves 36, 38. Also, whilst the height is greater than the width for all the transverse grooves, 30, 32 and 34, the width is greater than the height for the longitudinal grooves 36, 38.

As can now be appreciated, the present invention can be used to support a floating marine device, without the necessity of screws or any other fastening means violating the integrity of the float 10. According to the present invention, the transverse grooves 30, 32 and 34 all intersect with each longitudinal groove 36 and 38. Consequently, support members 60, 62 for supporting a marine device, such as a dock, will also intersect. In order to provide a flat surface, supported at a sufficient number of places to provide rigidity, the intersecting support members should extend slightly above the upper surface 21 of upper portion 22 of modular float 10. Also, all members should extend above surface 21 the same amount. This in turn requires that the longitudinal support members 62 and the transverse support members 60 be notched to accommodate each other when inserted into the intersecting grooves 30, 32 and 34, and 36 and 38. In the embodiment shown in FIG. 4, transverse members 60 are notched at 61 to accommodate longitudinal members 62. The longitudinal members 62 may also be notched, as shown in FIG. 4 at 63.

Of course, by being notched, the support members 60 and 62 become secured with respect to each other. However, it is anticipated that fasteners such as nails and screws will be required to secure the longitudinal support members 62 to the transverse support members 60. Even so, because the members 60 and 62 are secured to each other, and to the float 10, by means of the interlocking grooves previously described, a stable foundation is provided upon which the upper deck 64 of the dock, for example, can be placed.

Further, it will now be apparent that the modular floats 10, are capable of being secured under a dock or other floating device of virtually any configuration. Because of the transverse grooves 30, 32 and 34, and the longitudinal grooves 36 and 38, modular floats 10 can be secured either singly, or in combination, in one of two orientations, or can be mounted in combination for example, in parallel rows to form pontoons.

In the illustrated embodiment, the modular float 10 has the additional advantage of being easy to use. The float 10 may be placed on the ground, and the support members 60 and 62 placed therein from above. The floating device, whether it is a dock or raft, can be assembled, in the configuration desired when afloat. This is of considerable advantage over many of the prior art devices, which, in order to be assembled, must be upside-down, and, when fully constructed, flipped over.

Figure 3:
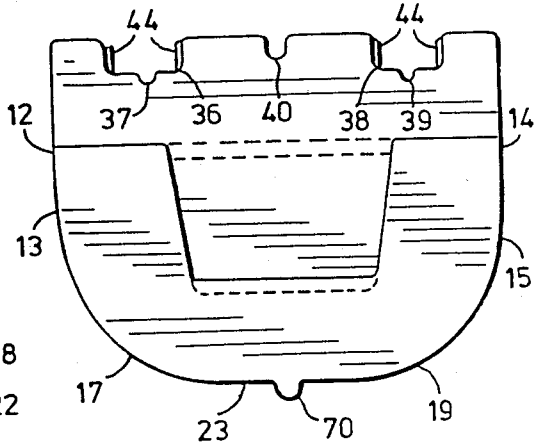
FIG. 3 is a right elevation view of the invention of FIG. 1.

Referring to FIG. 3, generally rounded lower portion 22 is shown in profile. As can be seen, the lower portion 22 smoothly joins side walls 12 and 14 at points 13 and 15 respectively. Then inwardly curving arcs 17 and 19 gently merge with a horizontal bottom section 23 having a centrally located keel 70. As a result of the curved profile, the amount of water displaced, and thereby the buoyant uplifting force provided, increases dramatically yet smoothly as the float 10 is forced deeper into the water. Therefore, it will be appreciated that the curved profile of the bottom portion 22 has the advantage of rendering the float 10 vertically stable under variable increases or decreases in loading.

Figure 2:
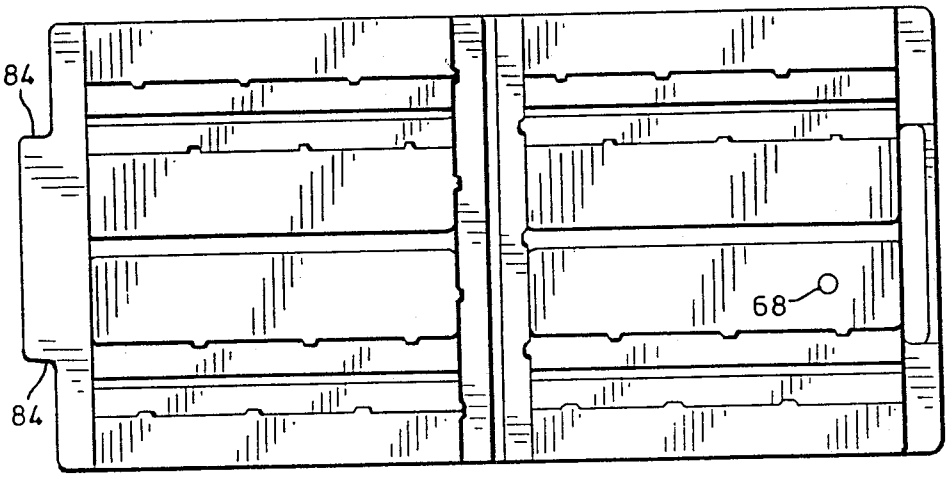
FIG. 2 is a top view of the invention of FIG. 1.

Another means of increasing the vertically stability of the modular float 10, is by means of a resealable port 68 shown in FIG. 2. Port 68 may be used to introduce water, or other ballast, into the float 10. In this fashion also, the float 10 may be raised or lowered in the water, so that the height of the marine device above the water can be precisely controlled.

The centrally located keel 70 also has a number of advantages. While positioning a floating structure such as a dock, or where a float is incorporated, for example, as a support for a pontoon boat, the keel 70 will provide some resistance to lateral motion, thereby making the dock or boat more manoeuverable. Also, when the dock or other marine device is to be removed from the water, keel 70 can act as a low friction rub rail, making it easier to move the marine device in and out of the water. Finally, when the modular float 10 is being shipped with other like modular floats, keel 70 can be securely fit into central longitudinal slot 40, to form a secure compact interlocked bundle of floats 10 which can be easily shipped.

It will now be appreciated that the modular float 10 of the present invention through a combination of features, facilitates the easy removal of the floating marine structure from the water. This may be required, for example when in northern locations due to icing conditions in the winter. The keel 70 acts as a friction reducing rub rail to allow the structure to be easily pulled up onto the shore. Because no fasteners are required, the modules 10 may be easily separated from the marine structure without requiring it to be flipped over to remove fasteners. The modular floats 10, can be conveniently stored, stacked one upon the other.

The central longitudinal groove 40, also has several advantages. As previously described it can be used to form a compact shipping bundle of like modular floats 10. In addition, however, when the float is assembled into a dock, for example, electrical conduits or plumbing can be conveniently located in the groove 40. This is also true of subchannel 31, which is dimensioned to receive a standard electrical conduit therein.

Returning now to FIGS. 1, 2 and 3, it will be seen that end 16 has male member 80 extending therefrom, and end 18 a corresponding female member 90. The male member 80 has a lower lip 82, which fits into lower groove 92 of female member 90. Male member 80 also has sloped side walls 84, which rest against sloped side walls 94 of female member 90. Finally, as can be seen in FIG. 4, when male member 80 is inserted into female member 90, the full transverse groove 88 is created, which extends from side wall 12 to side wall 14. By inserting male member 80 into female member 90, adjacent modular floats 10 may be both axially and rotationally secured.

It will of course be appreciated that the preceding description relates to a particular preferred embodiment of the invention and that many modifications are possible within the broad scope of the invention. Some of the modifications have been indicated above and others will be apparent to those skilled in the art. For example, while the invention has been described in relation to a dock structure, there is no limitation to this particular article. The floating marine device could also be a diving raft or even a pontoon boat, such as a houseboat.

Also, while the grooves 30, 32, 34, 36 and 38 are shown as being horizontal, it would be possible to slope these grooves slightly to facilitate drainage of any water therefrom. The bottom of the transverse grooves could slope downwards from the center to either side. Also, ridges **44*b* could also be usefully applied to the horizontal portions of the grooves, to allow more air to freely circulate around the support members 60 and 62**.

Figure 5:
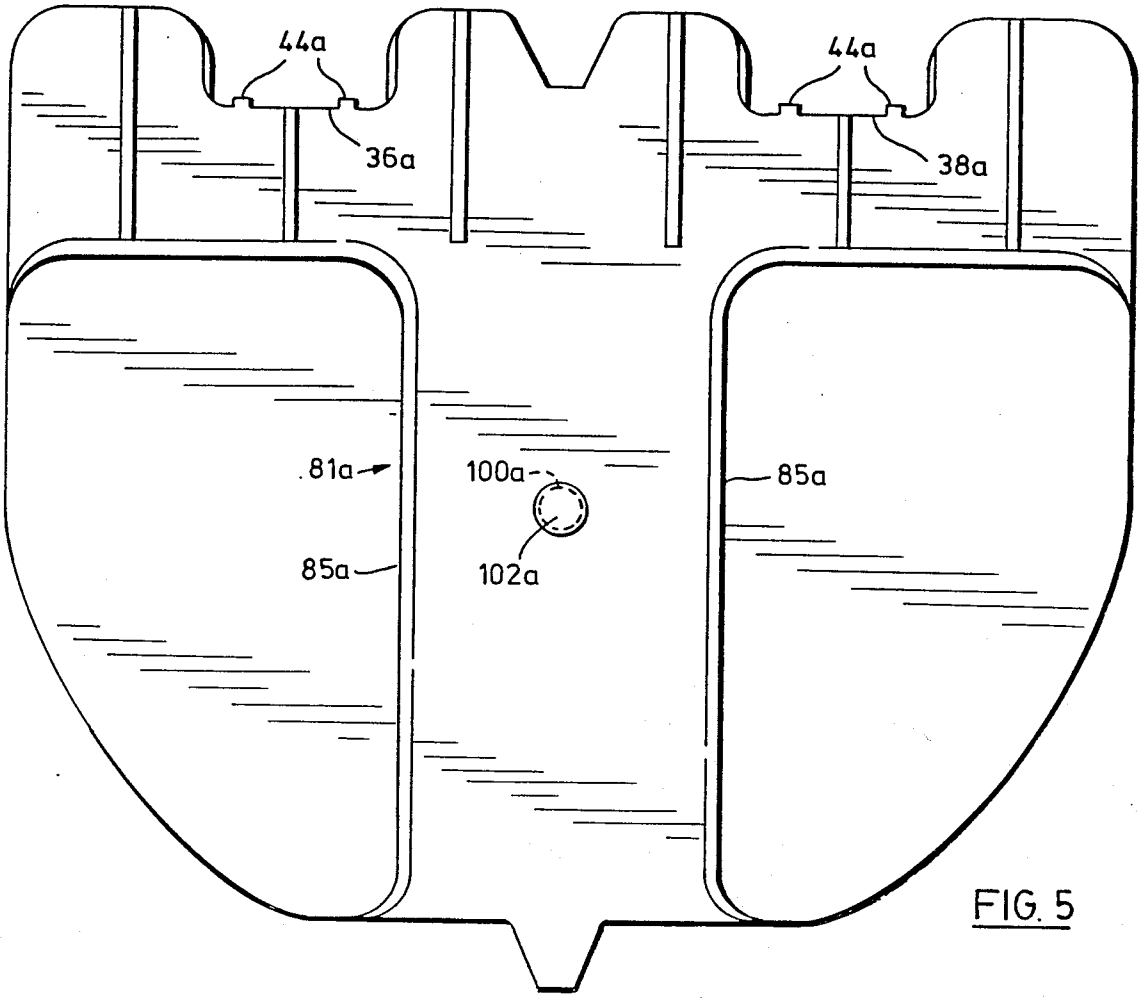
FIG. 5 is a side view of a female end according to a second aspect of the invention.
Figure 6:
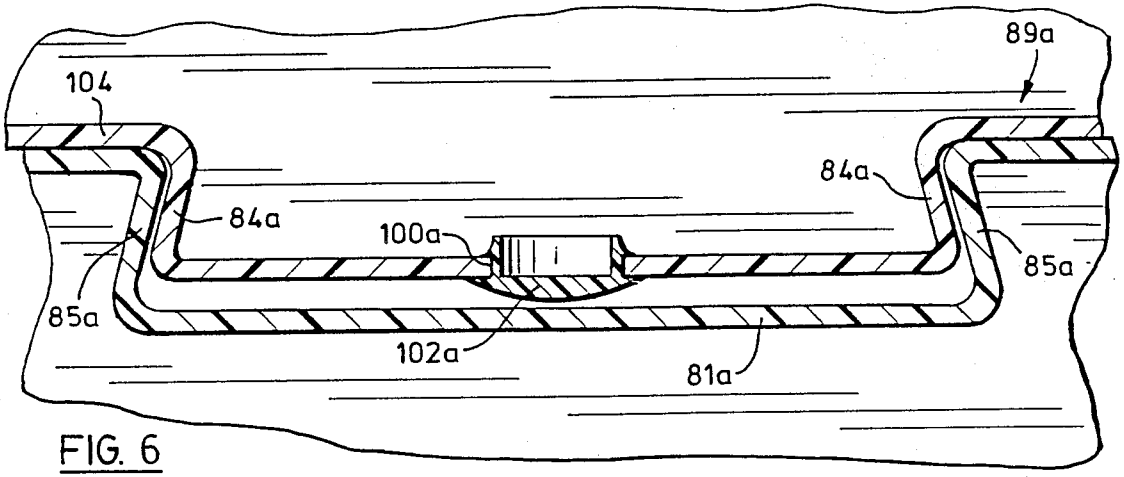
FIG. 6 is a view, partly in section, of a male end inserted into the female end according to the second aspect of the invention.

A second embodiment of the present invention is disclosed in FIGS. 5 and 6 in which like numerals with an 'a' after them are used to indicate like features as in the first embodiment. In the second embodiment, longitudinal grooves **36*a*, 38*a* may also be provided with raised ridges 44*a*, which function in the same manner as ridges 44 in the first embodiment. Similar ridges (not shown) are located in the transverse grooves. Raised ridges 44*a* are an alternative to central drainage channels 37 and 39** of the first embodiment.

In the second embodiment, male member **80*a* is in the form of a vertically oriented protrusion, which fits into the vertically oriented slot of female member 81*a*. Side edges 84*a* of the male member 80*a* are angled outward, so that joint 89*a* is a dovetail joint between male member 80*a* and female member 81*a*. The side walls 84*a* of the male member 80*a* and the corresponding lips 85*a* of the female member 81*a* are vertical, to facilitate the easy sliding of male member 80*a* into female member 81*a* to form an axially restraining rotationally stable joint 89*a*. Unlike the previous embodiment, there is no lower lip 92** to the female member.

Also shown in FIG. 5 is a sealed port **100*a*, which has a plug 102*a* inserted therein, to maintain the watertight nature of the sidewall 104*a* of float 10*a***.

We claim:

1. A floating marine device comprising an upper deck surface;

a plurality of transverse support members;

a plurality of longitudinal support members, said transverse support members and said longitudinal support members intersecting at right angles and having notches, with the longitudinal and transverse support members supporting the upper deck surface; and a plurality of modular floats, each float comprising an integral hollow closed shell having two side walls, two end walls, which include a male member at one end wall and a matching female member at the other end wall, a generally rounded lower portion when viewed from an end, and a generally rectangular upper portion when viewed from one end, said upper portion having at least one transverse groove extending between said side walls, and a plurality of longitudinal grooves extending between said end walls, each of said grooves having a bottom surface and side surfaces and opening upwardly, said longitudinal grooves and said transverse groove intersecting said grooves having ridges projecting inwardly into said grooves to space said support members off said surfaces of said grooves and having longitudinal drainage channels for transporting water out of said grooves.

2. A modular float for use in supporting marine devices having transverse and longitudinal support members, said modular float comprising:

an integral closed shell having two sidewalls, two end walls extending between said side walls, and an upper portion and a lower portion forming a top and a bottom therefor, said upper portion having at least one transverse groove extending between said side walls and a plurality of longitudinal grooves extending between said end walls, said grooves having two side surfaces and a bottom surface and opening upwardly, said transverse groove and said longitudinal grooves intersecting, said grooves having spacing means projecting inwardly for supporting said support members away from said surfaces of said grooves.

3. The modular float as claimed in claim 2, wherein the transverse grooves has a height greater than the height of the longitudinal grooves.

4. The modular float as claimed in claim 3, wherein for each transverse groove the height is greater than the width, and for each longitudinal groove the width is greater than the height.

5. The modular float as claimed in claim 4, which has a central transverse groove, and end transverse grooves, with each end transverse groove being formed as a step so that a full transverse groove is formed by adjacent end transverse grooves of coupled modular floats.

6. The modular float as claimed in claim 2, which includes a planar top surface with the grooves extending below the planar top surface.

7. The modular float of claim 2 wherein said spacing means comprises a plurality of spaced-apart ridges projecting into said grooves, said ridges resiliently deforming to releasibly retain said support members therebetween.

8. The modular float of claim 7 wherein said grooves further include drainage channels extending longitudinally along the bottom of the grooves for draining the grooves.

9. The modular float of claim 8 wherein said spaced apart ridges are located on the sides of said grooves and are vertically oriented, and said drainage channels slope downwardly to open ends of said grooves.

10. The modular float of claim 2, 7 or 8, wherein said two end walls further comprise a first male end, and a second female end, said female end accepting said male end to form a rotationally stable axially restraining joint, between like modular floats.

11. The modular float of claim 2 or 7 wherein said lower portion is generally rounded and of part circular section.

12. The modular float of claim 11 wherein said generally rounded lower portion further comprises a keel, said keel running longitudinally along said float and being located halfway between said side walls.

13. The modular float of claim 12 wherein said upper portion further comprises a centrally located longitudinally running channel, adapted to receive said keel, when said floats are being transported, and adapted to house electrical conduits and water pipe, when said floats are installed in a marine device.

14. The modular float of claims 2 or 7 having a resealable port, so that ballast may be added to said float to increase the vertical stability thereof under variable loading conditions.

* * * * *